US005564957A

United States Patent [19]

Breivik et al.

[11] Patent Number: 5,564,957

[45] Date of Patent: Oct. 15, 1996

[54] SYSTEM FOR OFFSHORE LOADING/UNLOADING OF A FLOWABLE MEDIUM, ESPECIALLY OIL

[75] Inventors: Kare Breivik, Tau; Arne Smedal, Farvik; Kare Syvertsen, Arendal, all of Norway

[73] Assignee: Den Norske Stats Oljeselskap A.S., Stavanger, Norway

[21] Appl. No.: 244,348

[22] PCT Filed: Mar. 30, 1992

[86] PCT No.: PCT/NO92/00054

§ 371 Date: Aug. 8, 1994

§ 102(e) Date: Aug. 8, 1994

[87] PCT Pub. No.: WO93/11031

PCT Pub. Date: Jun. 10, 1993

[30] Foreign Application Priority Data

Nov. 27, 1991 [NO] Norway ..... 914652

[51] Int. Cl.[6] ..... B63B 22/02

[52] U.S. Cl. ..... 441/5; 114/230

[58] Field of Search ..... 114/230, 324; 441/3–5

[56] References Cited

U.S. PATENT DOCUMENTS 1,233,489 7/1917 McDougall ..... 1.4/324
4,490,121 2/1986 Coppens et al. .
4,604,961 8/1986 Ortloff et al. .
4,701,143 10/1987 Key et al. ..... 441/5
4,892,495 1/1990 Svensen .

FOREIGN PATENT DOCUMENTS 2656274 6/1991 France .
2163403 2/1986 United Kingdom .

*Primary Examiner*—Stephen Avila
*Attorney, Agent, or Firm*—Keck, Mahin & Cate

[57] ABSTRACT

A system for transferring a flowable medium, especially oil, to or from a floating vessel, comprising a buoyancy unit in the form of a submerged buoy which is anchored to the sea bed by catenary mooring lines keeping the buoy submerged at a desired depth when it is not in use, at least one transfer line which is connected to the buoy, for the transfer of medium, a downwardly open receiving device arranged on the vessel below the water surface and arranged for receipt and connection of the buoy, a hoisting device provided on the vessel for raising of the buoy for introduction thereof into the receiving space, and a device enabling the vessel to turn about a vertical axis through the buoy when this is connected in the receiving space.

14 Claims, 5 Drawing Sheets

SYSTEM FOR OFFSHORE LOADING/UNLOADING OF A FLOWABLE MEDIUM, ESPECIALLY OIL

The invention relates to a system for transferring a flowable medium to or from a floating vessel, comprising a buoyancy unit in the form of a buoy which is anchored to the sea bed by means of catenary mooring lines keeping the buoy submerged at a desired depth when it is not in use, at least one transfer line which is connected to the buoy, for the transfer of medium, a downwardly open receiving means provided on the vessel below the water surface and arranged for receipt and connection of the buoy, a hoisting means provided on the vessel for raising of the buoy for introduction thereof into the receiving space, and a means enabling the vessel to turn about an essentially vertical axis through the buoy when this is connected in the receiving means.

A system of the above-mentioned type is known from e.g. U.S. Pat. No. 4,604,961 (corresponds to Norwegian patent specification No. 167 906). This known system is based on a vessel having a through-going deck opening in a central region of the vessel, the lower part of the through opening forming the receiving space for a mooring element in the form of a submerged buoy. In the receiving space there is arranged a rotating body (turret) which is rotatably mounted in the hull of the vessel and is designed for receipt and attachment of the mooring element, the latter to this end being provided with a hydraulically actuated locking mechanism for attachment to the rotating body. Further, the vessel is provided with a derrick for the lowering of a retrieval string having a retrieval connector at its lower end for interconnection with the mooring element, so that this may be pulled up and into the receiving space. The interconnection is obtained in that the mooring element is provided with a conical centering receptacle having a socket arranged at the bottom wherein the retrieval connector may be received and secured, e.g. by means of a bayonet lock. The lower end of the retrieval string preferably is provided with sonar and TV equipment to ensure position in of the retrieval connector in the centering receptacle.

The known system is encumbered with some drawbacks which will be discussed below.

As mentioned, the vessel of the known system is based on a through-going deck opening, which reduces the strength of the vessel and poses demands for additional reinforcements in the bottom and the deck of the vessel. Experience has also shown that ships having a through-going deck opening are subject to fatigue in the hull.

Since the rotating body is attached to the vessel under water, this requires divers for inspection and minor maintenance. Major maintenance requires docking of the vessel. Because of the fact that the rotating body is mounted to the vessel, there arise large frictional forces which are to be overcome by torques from the mooring element. Theses torques are relatively large due to the large outer diameter of the rotating body, and this results in correspondingly large loads. Further, it may result in uncontrolled rotation of the system because of large inertia forces, so that it becomes necessary to use a braking system for retaining the rotating body. In case of desired rotation the braking system is then released, and the rotating body is rotated in a controlled manner by means of active drive.

Further, the known system has a small ability to absorb moments caused by the horizontal mooring forces, something which results in a substantial risk for jamming actions in the mounting arrangement.

The hydraulically actuated locking mechanism which is arranged on the mooring element requires divers for connection of the control hydraulics. Diver operations in connection with connection and disconnection render the use of the system as a transport system impossible, when using shuttle tankers. Further, there is a big risk for faulty operation and damages in case of uncontrolled disconnection. In case of breakage of the hydraulic system there is no possibility for the connection of a back-up or auxiliary device.

As mentioned, connection/disconnection takes place by means of a derrick-operated string having a special retrieval means. When connecting, this requires small relative movements between vessel and mooring element/buoy, so that the connection can be carried out in a safe manner only under reiatively calm weather conditions. Also this circumstance makes the system unusable as a transport system with shuttle tankers. Further, the connecting as well as the disconnecting operation requires a relatively long time to be accomplished.

It is an object of the invention to provide a buoy loading system wherein connection and disconnection between vessel and buoy can be carried out in a simple and quick manner, even in bad weather.

Another object of the invention is to provide such a system making it possible for the buoy to remain connected to the vessel in all weathers, a quick disconnecticn being able to be carried cut if a weather limitation should be exceeded.

A further object of the invention is to provide a buoy loading system making it possible for the utilized vessels to be operated as usual ships with respect to service, repair and classification.

A further object of the invention is to provide a buoy loading system which gives a low total investment, which gives simple installation and dismantling, and which simultaneously gives the possibility to carry cut repairs and replacement of wear elements on board the vessel, without disconection of the buoy.

A still further object of the invention is to provide a system of the stated type which gives a high security in operation and a low risk for contaminating spill.

The above-mentioned objects are achieved with a system of the introductorily stated type which, according to the invention, is characterized by the characterizing features stated in claim 1.

In a preferred embodiment of the system according to the invention, the module forming the receiving means is built into or mounted in the bow portion of the vessel.

By arranging the receiving means at a submerged place at the cuter side of the hull of the vessel, one achieves the substantial advantage that no interference is made in the structure of the vessel with a through-going deck opening which will reduce the strength of the vessel. In addition, the tank structure of the vessel will be unaffected, so that the loading capacity is maintained. Further, with the above-mentioned advantageous embodiment wherein the module is built into the bow portion of the vessel, the module will be arranged in a region which from before will be constructed for absorbing large loads.

As an alternative to building the module into the vessel at a place inside of the ship's side, it may also be connected externally to the cuter side of the hull of the vessel.

The term "module" is here meant to cover both a prefabricated unit which can be mounted at the vessel side or in a space in the vessel suitable for the purpose, and a device which can be mounted or built at the intended place or in the intended space in the vessel.

The module arrangement according to the invention also gives the possibility for a simple and reasonable rebuilding of existing tankers for adaptation to the buoy loading system according to the invention. The vessels used in the system may be operated as shuttle tankers which may be classified as usual ships, the system enabling an easy and quick shut-off and disconnection of the buoy if this should be necessary, for example because of necessary repairs or a suddenly occurring gale.

As a result of the fact that the buoyancy unit or buoy in the system according to the invention comprises an outer buoyancy member and a member which is rotatably mounted centrally therein, the outer buoyancy member being looked in the inner space of the module by means of a locked mechanism in the module, one achieves that the rotary system which allows turning of the ship, is a part of the buoy itself. With other words, there is not required any expensive support as part of the vessel itself. Further, there is achieved a small diameter of the rotary bearing of the buoy, which gives a small rotational resistance, a small rotary mass and small torques. There will not be any need for active steering or braking of the rotation of the system.

The present buoy construction in addition gives a simple installation and dismantling, and correspondingly low costs. Since the buoy is of the submerged type where the buoy, when it is not in use, floats at a predetermined desired depth under the water surface, one also achieves the advantage that the buoy will not be damaged or represent any danger to seagoing traffic. The weight of the buoy normally will be in the range of 30–50 tons.

The invention will be further described below in connection with an exemplary embodiment with reference to the drawings, wherein Fig. 1 shows a view of a vessel and an anchored buoy, wherein the buoy is shown in a submerged position of equilibrium as well as in a connected condition;

FIGS. 2 and 3 shcw schematic side views of a part of a vessel which is designed in accordance with the system according to the invention;

In the various drawing Figures corresponding members and elements are designated by the same reference numerals.

As appears from FIGS. 1–3, the system includes a floating vessel 1 and a buoyancy unit or buoy 2 which is to be connected to the vessel in a module 3 arranged therein, which module in the following will be designated "receiving space". The vessel is a tanker, for example a so-called shuttle tanker, and the buoy is a loading/unloading buoy for the transfer of a flowable medium to or from tanks (not shown) on board the vessel. Normally, the flowable medium will be hydrocarbons (oil or gas), but the expression "flowable medium" here must be constructed in a wide sense, since it may also be the question of other flowable materials, also in powder or particle form.

Figure 1:
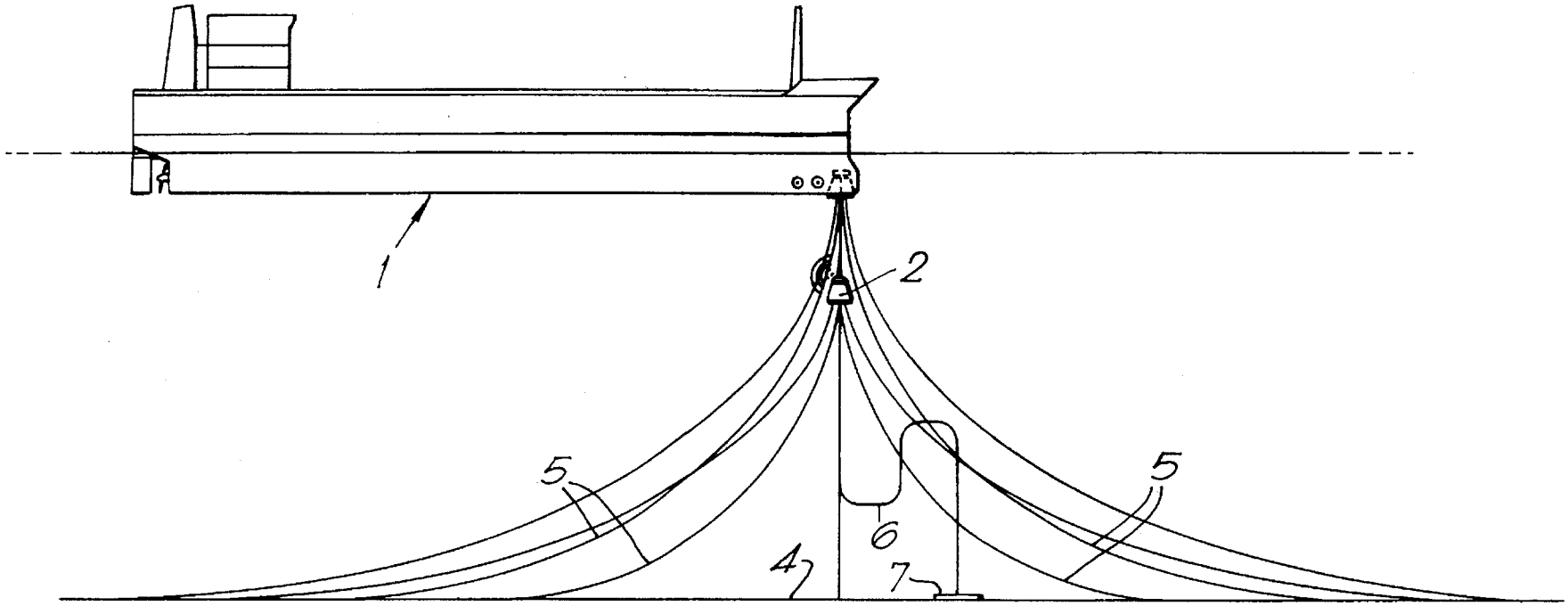

As shown in FIG. 1, the buoy 2 is anchored to the sea bed 4 by means of a suitable number of mooring lines 5 extending as catenary lines between the buoy 2 and suitable anchoring points at the sea bed 4. Each of the mooring lines may consist only of a chain, especially at smaller water depths. Generally, however, it is convenient that each of the mooring lines consists of a chain (partly resting on the sea bed) combined with an upper wire, an elastic hawser or the like, with or without buoyancy buoys (not shown) which may e.g. be placed in the connecting point between the chain and the wire, so that, for the anchoring system there is obtained a suitable stiffness/characteristic which is adapted to the vessel and water depth in question. Thereby it is achieved that the buoy can be executed in a standard design, independent of the water depth. When the buoy 2 floats in the sea in the lower position in FIG. 1, its buoyancy will be in equilibrium with the forces from the anchoring system, so that the buoy will float at a predetermined desired depth under the water surface, where it will not be damaged or represent any danger to seagoing traffic.

The buoy 2 is coupled to a transfer line 6 in the form of a flexible riser which is shown to extend between the buoy and a station 7 suggested at the sea bed. This station for example may be an installation for the supply or storage of oil, but generally symbolizes a place communicating with the buoy 2 in order to deliver flowable medium to or receive flowable medium from the buoy. In connection with e.g. offshore oil and gas production, the station 7 normally will be located at the sea bed. However, in other applications, it may be located at another place, for example in sheltered waters or on land. In such a case the buoy possibly may be "anchored" only by means of the flexible transfer line. Possibly, more than one transfer line may be connected to the buoy. It is also conceivable that the transfer line, or several transfer lines, is/are connected to a "station" in the form of a corresponding submerged buoy.

In the shown embodiment, the receiving space 3 is arranged in the lower part of the bow of the vessel 1. The receiving space 3 is connected with the deck 8 of the vessel through an access or service shaft 9. Further, in the receiving space 3, there is arranged a shutter 10 for shutting off the service shaft 9 and the upper part of the receiving space from the sea when the receiving space is not in use, i.e. when it does not receive a buoy 2. Among other things, this gives a possibility for inspection of equipment fitted in the shaft and the upper part of the receiving space.

In the deck area of the vessel there is arranged a hoisting means in the form of e.g. a winch 11 having a suitable line which can be lowered through the shaft 9 and the receiving space 3 and connected with the buoy 2, so that this can be hoisted up and moved in place in the receiving space 3. In FIGS. 2 and 3 said line is only suggested with a dash-dotted line 12, the buoy 2 here being shown after having been hoisted up and moved in place in the receiving space 3 by means of the line and the hoisting means. The method and the system for connecting the buoy to the vessel do not constitute a part of the present invention. For a further description of this aspect of the system, reference is made to the simultaneously filed international Patent application No. PCT/N092/00053.

In the system according to the invention the inner space of the module, i.e. the receiving space, has at least partly downwardly essentially conically enlarged shape, for mating with a buoyancy unit or buoy having a corresponding outer shape. This also appears from FIGS. 2 and 3 wherein the buoy 2 and the lower part of the receiving space 3 have mating cone shapes.

Figure 4:
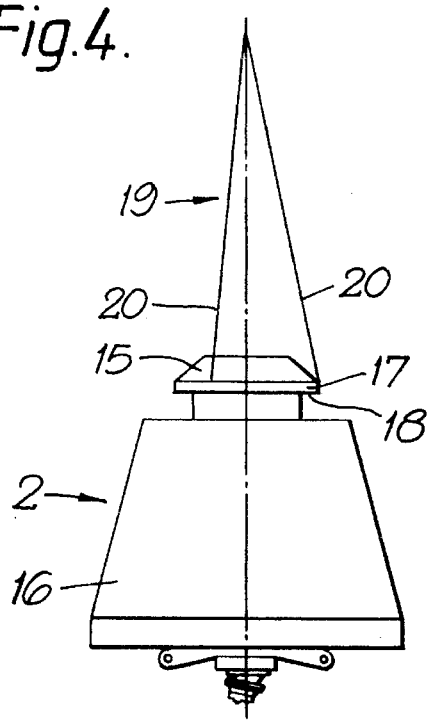
FIG. 4 shows a side view of a buoy in the system according to the invention.

An example of the outer configuration of the buoy is schematically shown in FIG. 4. In the illustrated embodiment the buoy 2 consists of an upper and a lower cone member 15 and 16, respectively, and the upper cone member 15 comprises a collar 17 having a downwardly facing annular abutment edge 18 for engagement with locking elements forming part of the locking mechanism arranged in the module for locking of the buoy 2 in the receiving space. Further, the buoy is provided with a so-called lifting bridle 19 which is fastened to the upper member 15 of the buoy and consists of two or more lines 20 forming a cone contour forming an upper continuation of the external cone shape of the buoy. This arrangement is advantageous for contributing to the buoy, in the initial phase of its introduction into the receiving space, being inserted in a safe and correct manner in the receiving space.

Figure 5:
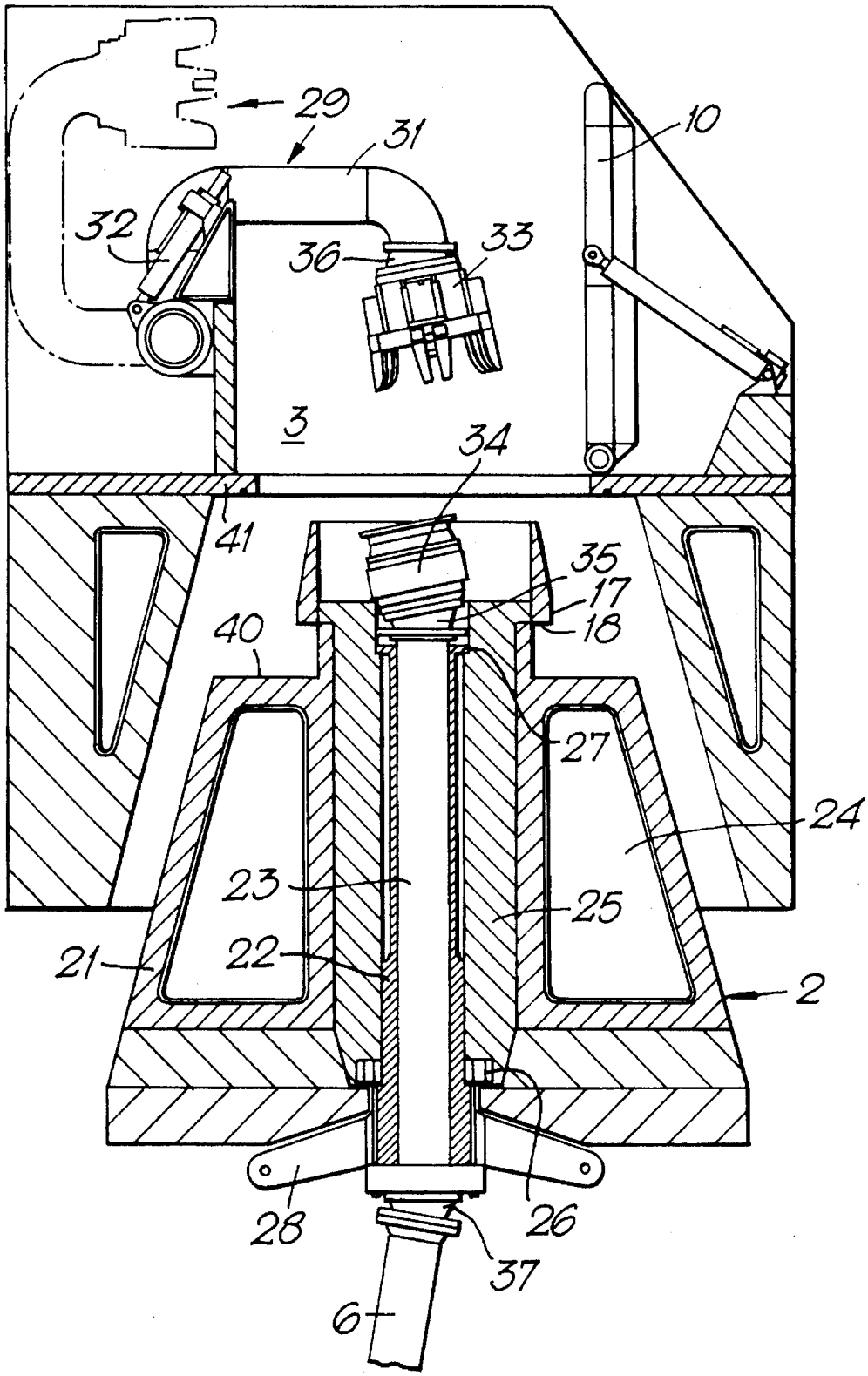
FIG. 5 shows a schematic sectional side view of an embodiment of a module or receiving space in a vessel and a buoy which is adapted to the receiving space.

The construction of the buoy 2 is shown more in detail in the longitudinal sectional view in FIG. 5. As shown, the buoy consists of an outer buoyancy member 21 and a central member 22 which is rotatably mounted in the outer member and has at least one through-going passage 23 for medium to be transported via the buoy. The outer member 21 is divided into several water-tight buoyancy Chambers 24, and further it comprises a central replaceable bearing support 25 having a lower radial bearing 26 and an upper axial bearing 27 for the central member 22. When required, the bearing support member 25 can be lifted up from the outer buoyancy member 21 for inspection and possible replacement of parts.

The central member 22, which has here the form of a hollow shaft, is provided with a lower reinforced portion having outwardly projecting arms 28 for attachment of the mooring lines 5 of the buoy 2 (not depicted in FIG. 5).

In the upper part of the receiving space 3 there is arranged a coupling unit 29 which is associated with a tube system 30 (see FIGS. 2 and 3) arranged on the vessel for medium transfer to or from tanks on the vessel. The coupling unit comprises a curved coupling tube 31 which, by means of a hydraulic cylinder 32, is pivotable between a stowed position and a connecting position (both positions shown in FIG. 5), one end of the tube being provided with a coupling head 33 for connection to the upper end of the central member 22 of the buoy when the buoy is in place in the receiving space. This connection takes place through a swivel means 34 which, in the illustrated embodiment, is coupled to the central member 22 through a flexible joint 35. Also the coupling head 33 comprises a flexible joint 36. The illustrated embodiment also includes a third flexible joint 37 which is arranged between the lower end of the central member and the transfer line 6 of the buoy. The flexible joints 35 and 36 especially are arranged for accomodating fairly large dimensional tolerances when connecting the buoy to different vessels, whereas the flexible joint 37 provides for moment-free transfer of forces from the transfer line 6 to the buoy, and in addition facilitates the positioning of the buoy relative to the receiving space 3, so that the buoy slides easily in place therein.

Figure 6:
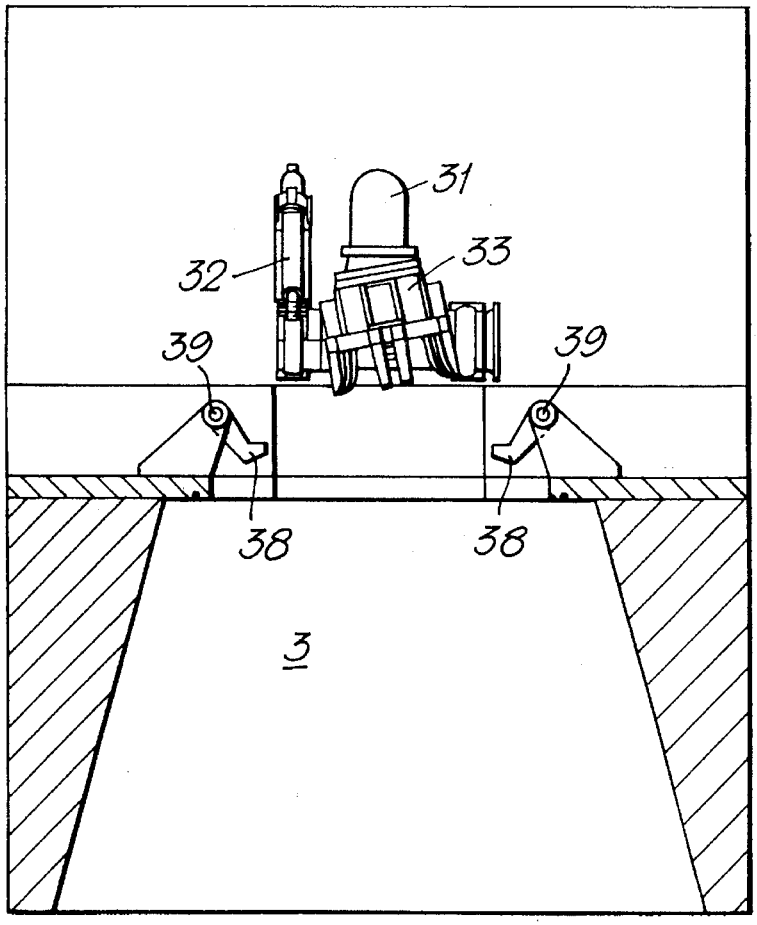
FIG. 6 shows a schematic sectional view of the receiving space in FIG. 5, at right angles to the sectional plane in FIG. 5.

The locking mechanism for releasable locking of the buoy when it is in place in the receiving space 3, is schematically shown in FIG. 6. In the illustrated embodiment the mechanism comprises a pair of locking dogs 38 which are actuated by a hydraulic system and are rotatable about horizontal axes 39 at diametrically opposite sides of the receiving space 3. If desired, more than two locking dogs may be provided. The hydraulic actuators for operation of the locking dogs may for example be hydraulic cylinders. These are not shown in the Figure. When activating the locking dogs 38, these will pivot in a vertical plane to engagement with the downwards facing abutment edge 18 (FIGS. 4 and 5) of the upper cone member. Advantageously, the hydraulic cylinders are connected in parallel to the hydraulic drive system, so that they automatically compensate for possible unevennesses in the abutment edge.

The locking dogs 38 provide for rigid locking of the outer buoyancy member 21 of the buoy to the receiving space 3 (the module), and the vessel 1 then is allowed to turn about the central member 22 which is rotatably mounted in the outer member 21, the swivel means 34 allowing such turning after the coupling tube 31 having been coupled to the buoy. Preferably, the hydraulic actuators are arranged to actuate a mechanical locking means (not shown), so that the buoy is kept securely in place in the looked position, also in case of failure in the hydraulic system.

Figure 2:
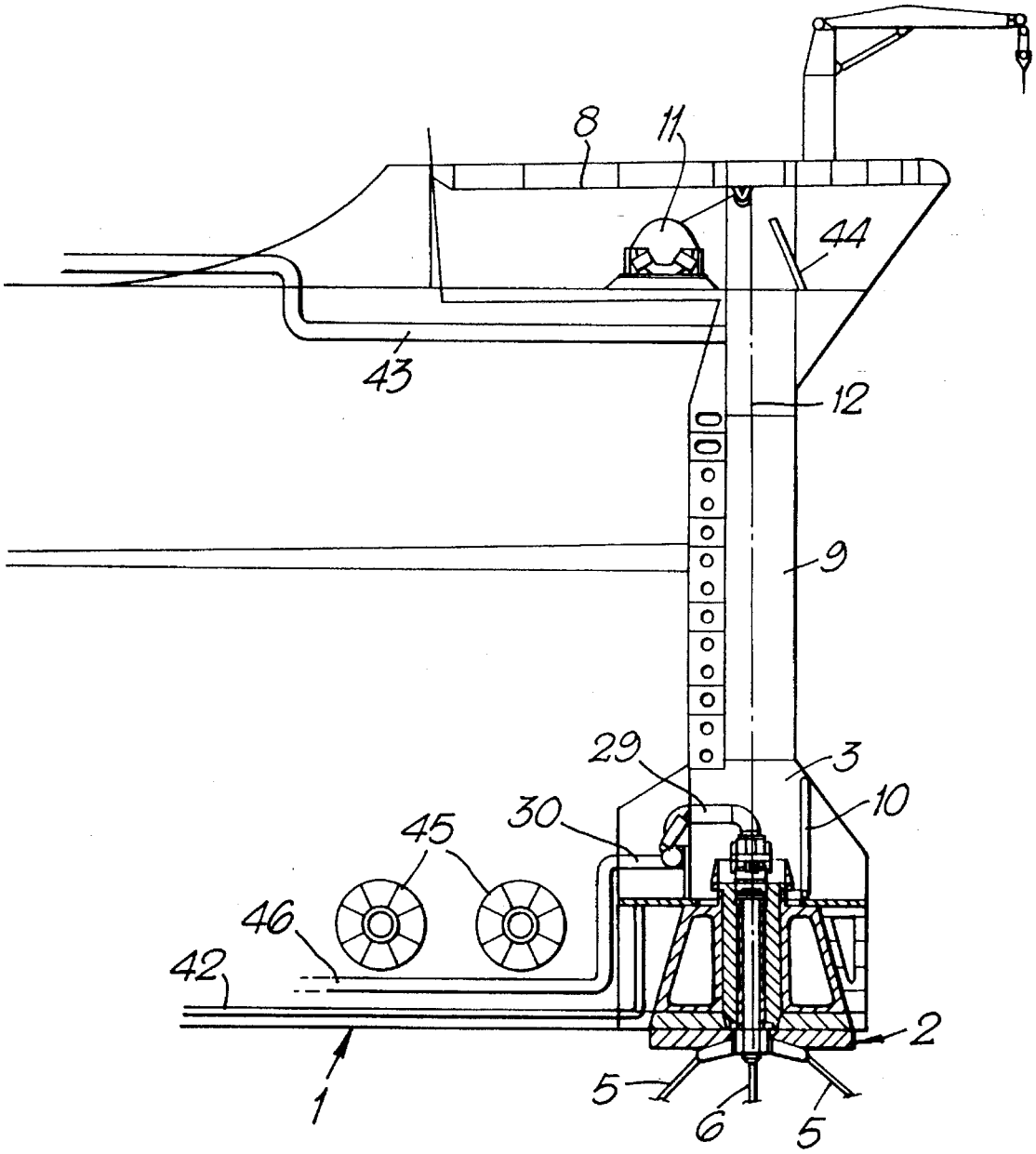
Figure 3:
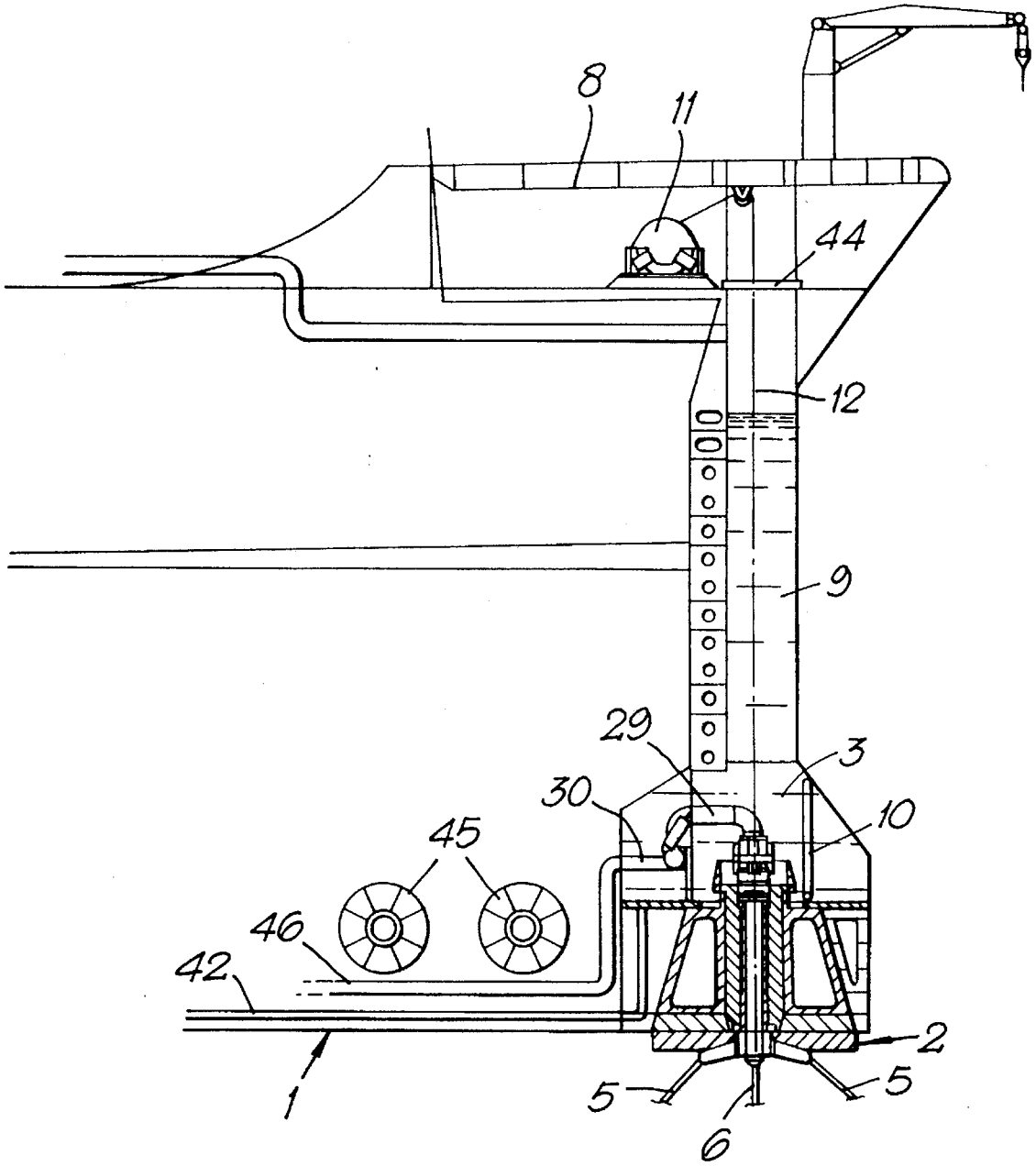

As appears from FIGS. 2 and 3, the shutter 10 is open when the buoy 2 is introduced into and locked in the receiving space 3. The upper part of the receiving space and a part of the service shaft 9 accordingly will be filled with water when the buoy is introduced in the receiving space, as shown in FIG. 3 (doted area). When the buoy 2 is locked in place in the receiving space, an upper abutment surface 40 on the outer member 21 of the buoy is brought into sealing abutment against a sealing flange 41 between the upper and lower parts of the receiving space 3 (see FIG. 5) so that the upper part of the receiving space and the service shaft 9 are shut off from the sea. The receiving space and the shaft then can be emptied of water, for example for inspection and maintenance purposes, the receiving space being connected to a drainage conduit 42 for this purpose, as shown in FIGS. 2 and 3. An additional drainage conduit (not shown) may be arranged between the receiving space and a collecting tank on the vessel, to drain possible leakage of transferred medium, such as oil, if such a leakage should occur, for example in connection with the coupling unit 29 in the receiving space.

The shaft 9 is also shown to be connected to a conduit 43 leading to the inert gas and ventilation system of the vessel. Further, the shaft at its upper end is provided with a closing means in the form of a shutter 44. The shaft and the upper part of the receiving space thereby can be filled with inert gas (after removal of the water), as a safety precaution prior to start of transfer of combustible or inflammable medium. In the case shown in FIG. 3 the water has not been removed, so that inert gas is only shown to fill the remaining upper part of the shaft.

The receiving space 3 and the service shaft 9 will be equipped with suitable sensors and TV cameras for monitoring and control purposes. There will also be arranged pumping equipment for drainage purposes, etc.

The vessel 1 in the usual manner is provided with bow thrusters 45 for use in positioning of the vessel. The space wherein the thrusters are installed, suitably may be connected to the receiving space 3, so that the receiving space is accessible from the thruster space, and vice versa.

As suggested in FIGS. 2 and 3, the tube system 30 in the receiving space is coupled to a bottom conduit 46 extending along the bottom area of the ship and communicating with the tanks of the vessel. This implies that the transfer line 6 or riser which is coupled to the buoy in the present system is connected directly to the bottom conduit of the vessel, without passing via a pipeline system on the deck of the vessel, in the way it is usual and necessary in conventional systems. This is a substantial advantage in loading or unloading of oil, since one then avoids carrying the oil via a point having a high location in the conduit system (i.e. on the deck), with a pressure drop and consequential gas formation (de-gassing), something which may result in that a not unessential part of the transported oil is lost.

We claim:

1. A system for transferring a flowable medium to or from a floating vessel having a deck, said system comprising:

a buoy adapted to be anchored to the sea bed so as to be submerged at a desired depth when not in use, at least one transfer line for transfer of said flowable medium connected to said buoy, a module built into a submerged part of the bow region of the vessel, a submerged downwardly open receiving space in said module, said receiving space being adapted for reception and securement of the buoy therein, and said receiving space and said buoy having at least partly matching upwardly tapering shapes, said buoy comprising an outer buoyancy member adapted to be releasably secured in said receiving space, and a central member on which said outer member is rotatably mounted, whereby said vessel can turn about a substantially vertical axis through said buoy when said buoy is secured in said receiving space, means on said central member for anchoring of said buoy, tubing for said flowable medium on said vessel, a coupling unit for passage of said flowable medium from said transfer line to said tubing, a deck on said vessel, a service shaft communicating said receiving space with said deck, a hoisting means on said vessel, and a sink line adapted to be lowered through said receiving space for connection with and hoisting of said buoy into said receiving space by said hoisting means, means on said buoy adapted to seal off the lower end of said service shaft when said buoy is secured in said receiving space.

2. The system of claim 1 further comprising means on said buoy adapted to seal off the lower end of said service shaft when said buoy is secured in said receiving space.

3. The system of claim 1 further comprising closing means at the upper end of said service shaft and an inert gas conduit of said vessel coupled to said service shaft.

4. The system of claim 1 further comprising at least one drainage conduit connected to said receiving space for drainage of liquid from said receiving space and said shaft.

5. The system of claim 1 wherein said central member of said buoy comprises a hollow shaft.

6. The system of claim 5 wherein said hollow shaft has a lower reinforced portion for attachment of catenary mooring lines for anchoring said buoy to the sea bed.

7. The system according to claim 1 wherein the buoy further comprises a support member supporting said central member, said support member being removable from said outer buoyancy member for inspection and servicing.

8. The system of claim 1 wherein said outer buoyancy member comprises upper and lower at least partly conical portions, and further comprising a locking mechanism having locking elements in said receiving space, and a downwardly facing, annular abutment edge on said upper portion for engagement by said locking elements to releasably secure said buoyancy member in said receiving space.

9. A system for transferring a flowable medium to or from a floating vessel having a deck, said system comprising:

a buoy adapted to be anchored to the sea bed so as to be submerged at a desired depth when not in use, at least one transfer line for transfer of said flowable medium connected to said buoy, a module built into a submerged part of the bow region of the vessel, a submerged downwardly open receiving space in said module, said receiving space being adapted for reception and securement of the buoy therein, and said receiving space and said buoy having at least partly matching upwardly tapering shapes, said buoy comprising an outer buoyancy member adapted to be releasably secured in said receiving space, and a central member on which said outer member is rotatably mounted, whereby said vessel can turn about a substantially vertical axis through said buoy when said buoy is secured in said receiving space, said outer buoyancy member comprises upper and lower at least partly conical portions, and further comprising a locking mechanism having locking elements in said receiving space, and a downwardly facing, annular abutment edge on said upper portion for engagement by said locking elements to releasably secure said buoyancy member in said receiving space, said locking elements comprise at least two locking dogs mounted for pivoting about horizontal axes between locking and release positions and wherein said locking mechanism further comprises hydraulic means for pivoting said locking dogs, means on said central member for anchoring of said buoy, tubing for said flowable medium on said vessel, a coupling unit for passage of said flowable medium from said transfer line to said tubing, a deck on said vessel, a service shaft communicating said receiving space with said deck, a hoisting means on said vessel, and a sink line adapted to be lowered through said receiving space for connection with and hoisting of said buoy into said receiving space by said hoisting means.

10. The system of claim 9 wherein said hydraulic means comprises hydraulic actuators and wherein said locking mechanism further comprises mechanical locking means whereby said buoy is kept securely in place in said receiving space in case of failure of said hydraulic means.

11. A system for transferring a flowable medium to or from a floating vessel having a deck, said system comprising:

a buoy adapted to be anchored to the sea bed so as to be submerged at a desired depth when not in use, at least one transfer line for transfer of said flowable medium connected to said buoy, a module built into a submerged part of the bow region of the vessel, a submerged downwardly open receiving space in said module, said receiving space being adapted for reception and securement of the buoy therein, and said receiving space and said buoy having at least partly matching upwardly tapering shapes, said buoy comprising an outer buoyancy member adapted to be releasably secured in said receiving space, and a central member on which said outer member is rotatably mounted, whereby said vessel can turn about a substantially vertical axis through said buoy when said buoy is secured in said receiving space, means on said central member for anchoring of said buoy, tubing for said flowable medium on said vessel, a coupling unit for passage of said flowable medium from said transfer line to said tubing, said coupling unit comprises a pivotable coupling tube having a free end, a flexible joint and a coupling head connected at said free end by said flexible joint, and wherein a swivel means on said central member is adapted to be connected to said coupling head a deck on said vessel, a service shaft communicating said receiving space with said deck, a hoisting means on said vessel, and a sink line adapted to be lowered through said receiving space for connection with and hoisting of said buoy into said receiving space by said hoisting means.

12. The system of claim 11 further comprising a flexible joint coupling the upper end of said central member to said swivel means.

13. The system of claim 1 further comprising a flexible joint coupling said central member to said transfer line.

14. A system for transferring a flowable medium to or from a floating vessel having a deck, said system comprising:

a buoy adapted to be anchored to the sea bed so as to be submerged at a desired depth when not in use, at least one transfer line for transfer of said flowable medium connected to said buoy, a module built into a submerged part of the bow region of the vessel, a submerged downwardly open receiving space in said module, said receiving space being adapted for reception and securement of the buoy therein, and said receiving space and said buoy having at least partly matching upwardly tapering shapes, said buoy comprising an outer buoyancy member adapted to be releasably secured in said receiving space, and a central member on which said outer member is rotatably mounted, whereby said vessel can turn about a substantially vertical axis through said buoy when said buoy is secured in said receiving space, means on said central member for anchoring of said buoy, tubing for said flowable medium on said vessel, a coupling unit for passage of said flowable medium from said transfer line to said tubing, a bottom conduit leading to one or more tanks on said vessel said tubing being coupled directly to said bottom conduit a deck on said vessel, a service shaft communicating said receiving space with said deck, a hoisting means on said vessel, and a sink line adapted to be lowered through said receiving space for connection with and hoisting of said buoy into said receiving space by said hoisting means.

* * * * *

UNITED STATES PATENT AND TRADEMARK OFFICE

CERTIFICATE OF CORRECTION

PATENT NO. : 5,564,957

DATED : October 15, 1996

INVENTOR(S) : Kare Breivik, Arne Smedal, & Kare Syvertsen

It is certified that error appears in the above-identified patent and that said Letters Patent is hereby corrected as shown below:

Col. 2, line 27, delete "cut" and substitute - out -

Col. 2, line 36, delete "cut" and substitute - out -

Col. 2, line 50, delete "cuter" and substitute - outer -

Col. 2, line 62, delete "cuter" and substitute - outer -

Col. 3, line 37, delete "shcw" and substitute - show -

Signed and Sealed this

Eleventh Day of February, 1997

Bruce Lehman

*Attest:*

BRUCE LEHMAN

*Attesting Officer*

*Commissioner of Patents and Trademarks*